US008480016B2

(12) United States Patent
Pallmann

(10) Patent No.: US 8,480,016 B2
(45) Date of Patent: Jul. 9, 2013

(54) DEVICE FOR PROCESSING FEEDSTOCK

(75) Inventor: Hartmut Pallmann, Zweibrücken (DE)

(73) Assignee: Pallmann Mascinenfabrik GmbH & Co. KG, Zweibruecken (DE)

( * ) Notice: Subject to any disclaimer, the term of this patent is extended or adjusted under 35 U.S.C. 154(b) by 0 days.

(21) Appl. No.: 12/777,798

(22) Filed: May 11, 2010

(65) Prior Publication Data

US 2010/0282881 A1 Nov. 11, 2010

(30) Foreign Application Priority Data

May 11, 2009 (DE) ..... 10 2009 020 714

(51) Int. Cl.
*B02C 18/18* (2006.01)

(52) U.S. Cl.
USPC ..... 241/62; 241/67; 241/261.1; 241/295

(58) Field of Classification Search
USPC ..... 241/261.1, 293, 295, 260.1, 62, 67
See application file for complete search history.

(56) References Cited

U.S. PATENT DOCUMENTS

| | | | | |
|---|---|---|---|---|
| 1,718,184 | A * | 6/1929 | Ostermann | 241/18 |
| 3,427,690 | A * | 2/1969 | Haug | 19/66 R |
| 4,562,972 | A | 1/1986 | Hagiwara et al. | |
| 5,544,824 | A | 8/1996 | Inoki | |
| 5,637,434 | A | 6/1997 | Ikushima et al. | |
| 5,845,855 | A | 12/1998 | Yamada et al. | |
| 5,938,928 | A | 8/1999 | Engel et al. | |
| 6,637,434 | B2 | 10/2003 | Noble | |

FOREIGN PATENT DOCUMENTS

| | | | |
|---|---|---|---|
| DE | 35 43 370 | A1 | 6/1987 |
| DE | 195 09 808 | A1 | 9/1995 |
| DE | 196 49 338 | A1 | 10/1997 |
| DE | 100 53 946 | A1 | 4/2002 |
| DE | 103 26 457 | A1 | 11/2004 |
| DE | 10 2004 014 258 | A1 | 10/2005 |
| EP | 0 122 608 | A2 | 10/1984 |
| EP | 0 696 475 | A1 | 2/1996 |
| EP | 0 775 526 | A1 | 5/1997 |

* cited by examiner

*Primary Examiner* — Mark Rosenbaum
(74) *Attorney, Agent, or Firm* — Muncy, Geissler, Olds & Lowe, PLLC

(57) ABSTRACT

A device for mixing, grinding, drying, deagglomeration, crushing, or coating of feedstock with a rotor is provided, rotating around an axis within a housing, and a stator, fixed relative to the housing, encompassing the rotor with maintenance of a radial working gap. The rotor has rotor tools, which are distributed over its outer surface and whose active edges for crushing the feedstock work together with the stator tools on the inner circumference of the stator. In this regard, the feedstock is supplied in the carrier gas stream to the working gap. For effective processing of the feedstock, it is proposed according to the invention that in the outer surface of the rotor a plurality of indentations is introduced, whereby areas between two adjacent indentations form webs, which form the active edges of the rotor tools.

18 Claims, 6 Drawing Sheets

Fig. 3a
Fig. 3b
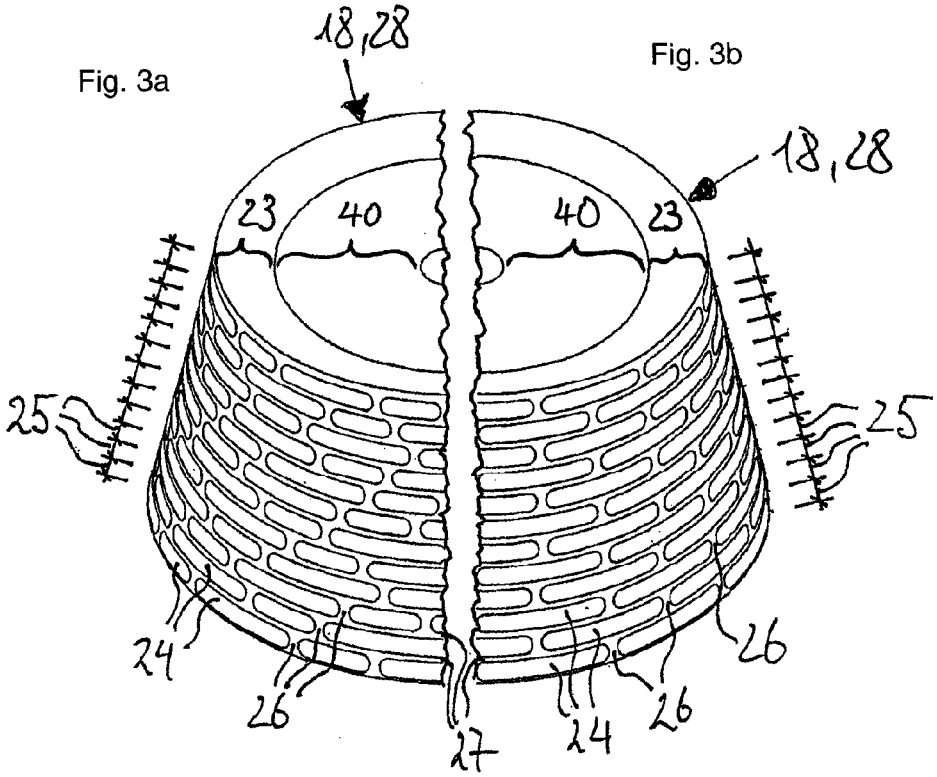
Fig. 4a
Fig. 4b
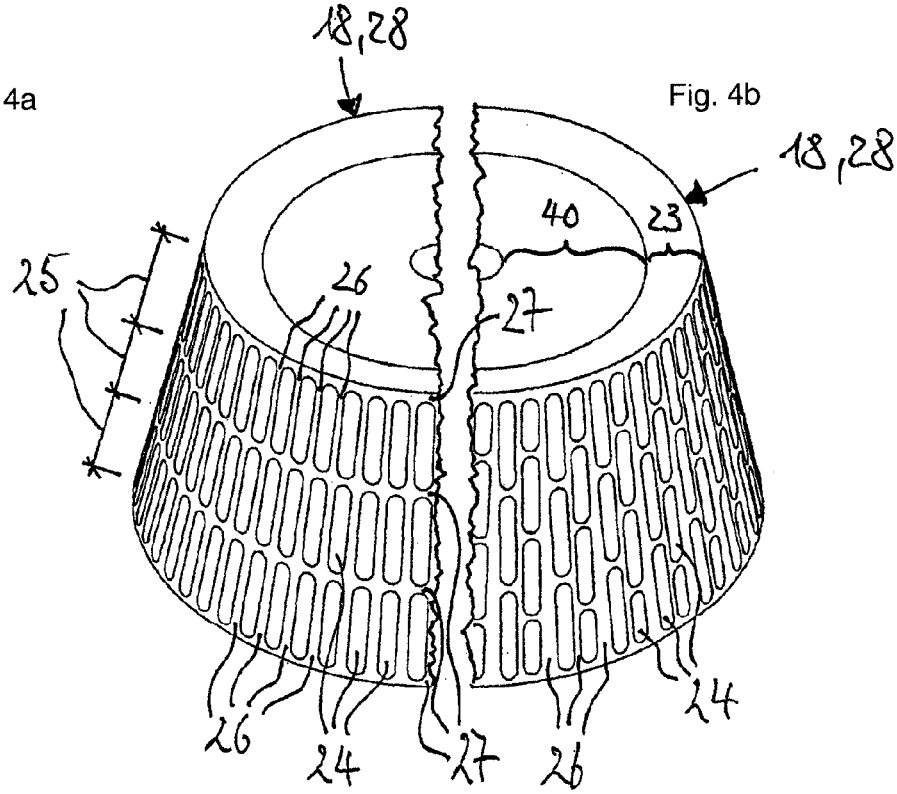

DEVICE FOR PROCESSING FEEDSTOCK

This nonprovisional application claims priority under 35 U.S.C. §119(a) to German Patent Application No. DE 10 2009 020 714.7, which was filed in Germany on May 11, 2010, and which is herein incorporated by reference.

BACKGROUND OF THE INVENTION

1. Field of the Invention

The invention relates to a device for processing feedstock.

2. Description of the Background Art

Conventional devices for processing feedstock belong to the field of mechanical process engineering. This concerns changing a source material in its form, size, and/or composition. For example, during crushing, grinding, or deagglomeration, a source material is taken from an original size to a comparatively smaller form. During mixing, different components in the feedstock are prepared so that a uniform particle distribution in the feedstock is achieved at the end. During coating or drying, heat is introduced selectively into the feedstock with the processing of the feedstock, to enclose individual particles and/or to evaporate the residual moisture in the feedstock.

Depending on the type of feedstock and the type of processing, generic devices are equipped with suitable rotor tools, which because of the intense contact with the feedstock are subject to more or less extensive wear, which starting at a certain degree has a negative impact on the quality of the processed end product. For this reason, in prior-art devices the rotor tools are attached removably in the device, to be able to replace worn rotor tools at regular time intervals. At the same time, in terms of economic operation, operators make the effort to minimize the tool changing times, to keep production loss due to down times of the device within reasonable limits.

DE 35 43 370 A1 discloses a mill, through which air flows, with an approximately cylindrical mill housing along whose inner circumference a stator is disposed. The stator with maintenance of a radial working gap encompasses a coaxially oriented rotor, whose drive shaft crosses the housing axially and is held rotatable within bearings. Hub sections are seated axially one behind the other on the drive shaft; of these a hub section each is assigned to a grinding stage. Each hub section carries a rotor disc, on whose outer circumference lastly the radially oriented impact plates are located, which at a radial distance strike along the stator inner surface.

Via a centric feedstock feed in the bottom area of the housing, the feedstock reaches the air current within the device and passes through the housing in the working gap in a helical path. In this regard, the processing of the feedstock occurs during the interaction of grinding plates and stator. After it leaves the working gap, the feedstock is removed via a tangential feedstock exit in the upper housing area of the machine.

A disadvantage of this device arises from the type of attachment of grinding plates to the rotor discs with the use of screws. The arrangement of several grinding stages axially one behind the other and the plurality of grinding plates per grinding stage result in substantial mounting costs during the wear-related change of the grinding plates.

In this regard, improvement can be achieved by the further development of the type of attachment of tools on the rotor. Thus, the devices disclosed in DE 100 53 946 A1, DE 196 49 338 A1, and DE 10 2004 014 258 A1 have rotors, which have retainers that are uniformly distributed along their circumference and in which the rotor tools are inserted axially. A form fit between the rotor and rotor tools assures that the tools are held in the radial direction. This greatly reduces the effort when rotor tools are changed, because the mounting effort with use of screw connections does not apply. Moreover, a considerable amount of work is associated, furthermore, with the successive changes of the individual rotor tools.

In addition, it is a disadvantage in all of the aforementioned devices that the geometric configuration of the crushing zone is possible only within narrow limits. The reason for this is the type of construction, which always envisions axially running grinding plates or hammers which project over the rotor circumference. A variation in the design of the hammers and the turbulence zones lying behind them is therefore possible only to a limited extent.

SUMMARY OF THE INVENTION

It is therefore an object of the present invention to provide a generic device that, on the one hand, enables a rapid change of the rotor tools and, on the other, offers maximum latitude in the realization of the crushing zone.

A rotor within the meaning of the invention has at least one rotor element, which is subdivided in the radial direction into an inner area, forming a bearing body, which is connected rotationally fixed to the drive shaft, and an outer area forming the rotor tools. The bearing body in this regard extends radially outward from the drive shaft and supports the rotor tools forming the outer surface of the rotor. A rotor of the invention can only have a single rotor element of this type that extends essentially over the entire axial length of the rotor, or several rotor elements of this type that, joined axially to one another, result in the rotor.

In a rotor of the invention, the rotor tools are an integral part of the rotor element; this means that the bearing body and rotor tools are monolithic, therefore made from a single workpiece, for example, by milling, drilling, electrical discharge machining, casting, and the like. The invention differs thereby from devices with a multiple-part rotor, in which the bearing body and the rotor tools represent separate parts, which are put together removably, for example, by screwing or insertion, or unremovably, for example, by welding.

This type of construction doubtlessly represents a clear moving away from prior-art devices on whose rotors strip-shaped rotor tools are always attached. The invention thus marks a turning point in the construction of generic devices.

In an embodiment, a feature includes producing the rotor tools by arrangement of indentations on the rotor surface, whereby both the webs present between the indentations and the indentations themselves have no effect on the type of feedstock processing. Because the rotor tools in such a rotor are machined out of the surface of one or more rotor elements, therefore from the solid, an immense latitude results in the geometric configuration of the processing zone. Whereas in prior-art devices the processing zone is formed essentially by grinding plates, it can now be achieved by suitable formation of the indentations that not only the webs but also the indentations make an active contribution during feedstock processing. Thus, the creation of eddies within the turbulence zone can be selectively controlled by the size and geometry of the indentations. It is also possible by varying the geometry of the indentations in their sequence in the circumferential direction to increase the intensity of the processing and thereby to achieve an improvement in performance.

In this regard, is an embodiment of the invention, in which the bearing body has a massive solid body, for example, a solid cylinder or solid truncated cone, which has a bored hole for the form-fitting accommodation of the drive shaft only axially. A rotor of this type offers sufficient radial depth for all types of indentations, without detrimentally affecting rotor stability.

The constructional design of the invention further provides the advantage that a change of rotor tools occurs by the replacement of the rotor or rotor elements; i.e., all rotor tools as well are changed concurrently with the replacement of the rotor. A device of the invention is thereby notable for extremely short down times during tool replacement.

Moreover, a rotor of the invention opens up the possibility, with the same construction height, to place more circumferential planes in the axial direction and more active edges along the circumference than is the case with prior-art rotors. Due to the resulting density of rotor tools, a device of the invention is notable for a very high machine performance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIGS. 3*a* to 4*b* show oblique views of different embodiments of a rotor of the invention;

DETAILED DESCRIPTION

Figure 1:
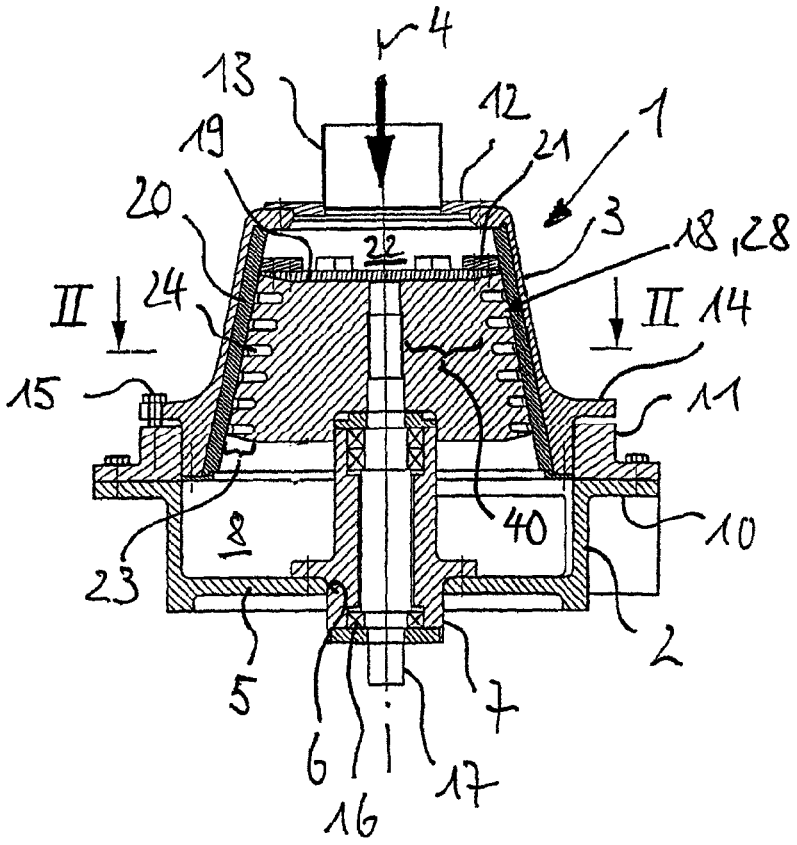
FIG. 1 shows a longitudinal section through a device of the invention along the line I-I depicted in FIG. 2.
Figure 2:
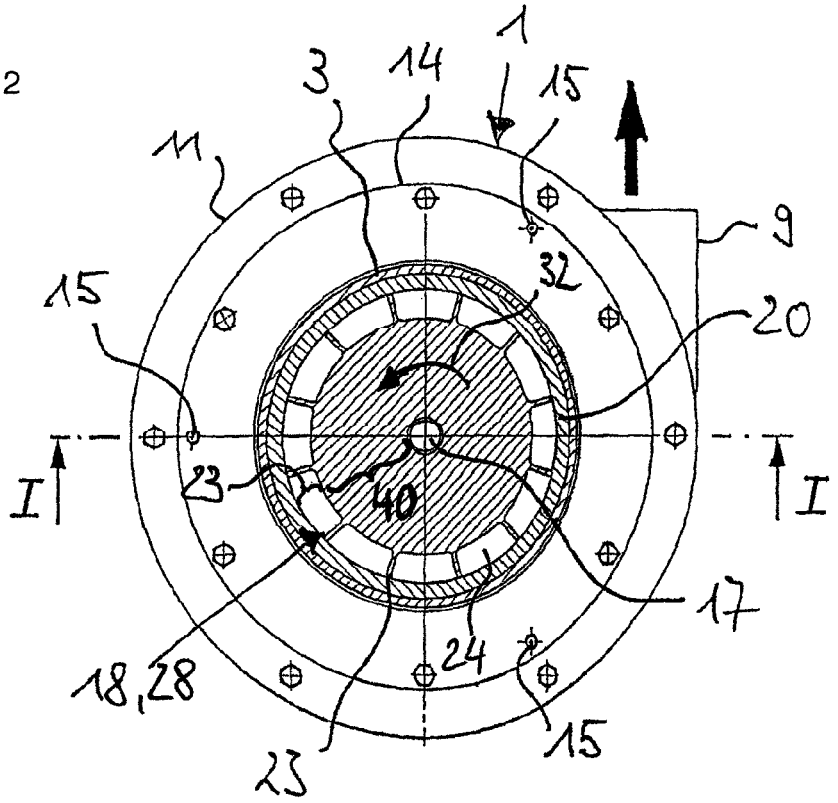
FIG. 2 shows a horizontal section through the device shown in FIG. 1 along the line II-II there.

The general structure of a device of the invention emerges from FIGS. 1 and 2. Evident there is a housing 1, which is made up of a cylindrical bottom part 2 and a bell-shaped top part 3. The longitudinal axis of housing 1 is provided with the reference character 4. The bottom part 2 is closed downward by a bottom 5 in which a circular opening 6 is disposed centric to axis 4. Opening 6 is used for accommodating an essentially cylindrical shaft bearing 7, which is screwed on coaxially to axis 4 by means of a flange connection on bottom 5. The upper end of shaft bearing 7 extends into the area of the top part 3. An annular channel 8, which opens out of housing 1 via a material outlet 9, tangential to axis 4, results in this way within the bottom part 2. The upper closure of the bottom part 2 is formed by a circumferential annular flange 10, to which a bearing ring 11, angular in cross section, is attached.

As already mentioned, the outer form of the top part 2 is bell-shaped, whereas the inner circumference of the top part 2 has a conical course and is used to accommodate stator tools 20. The top side of the top part 2 is closed by a removable cover 12, which in the area of axis 4 has a centric opening, to which an inlet connection 13 for loading the device with feedstock is connected coaxially.

The base area of the top part 2 is formed complementary with its outer circumference to the inner circumference of bearing ring 11, so that the top part 3 can be inserted with its base area axially into the bottom part 2. An annular flange 14, running plane parallel and coaxially at the outer circumference, which is connected by means of a screw connection to the bottom part 2, is used for the secure attachment of the top part 3 to the bottom part 2. The insertion depth of the top part 3 into the bottom part 2 can be adjusted via adjusting screws 15, which extend axially through the annular flange 14 and rest on the top side of the bearing ring 11.

Within the shaft bearing 7, the drive shaft 17, oriented coaxially to axis 4, is held rotatably in bearing groups 16. The lower end of drive shaft 17, lying outside housing 1, is connected to a rotary drive not illustrated further. The opposite end, lying within the interior of housing 1, extends well into the area of the top part 3 and is used for the rotationally fixed accommodation of a rotor 18. The rotor 18 includes a rotor element 28, which itself is formed solid; i.e., it is made of solid material and according to the contour of the inner circumference of the top part 3 has a truncated-cone form; this does not preclude that rotor 18 can also be made cylindrical in the case of a cylindrical housing, The solid design of rotor 18 moreover permits the placement of cooling channels (which are not shown), which extend, for example, parallel to the surface line into the area near the circumference and for cooling the processing zone are supplied with a cooling fluid.

Figure 5:
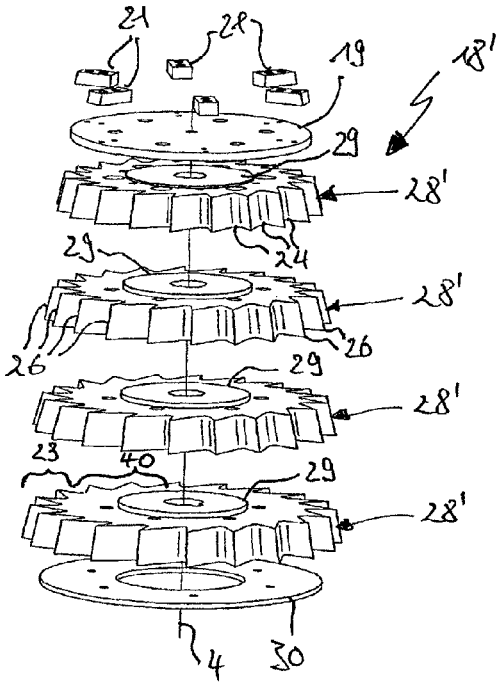
FIGS. 5 and 6 show exploded views of an embodiment of a rotor, assembled of disc-shaped rotor elements.
Figure 6:
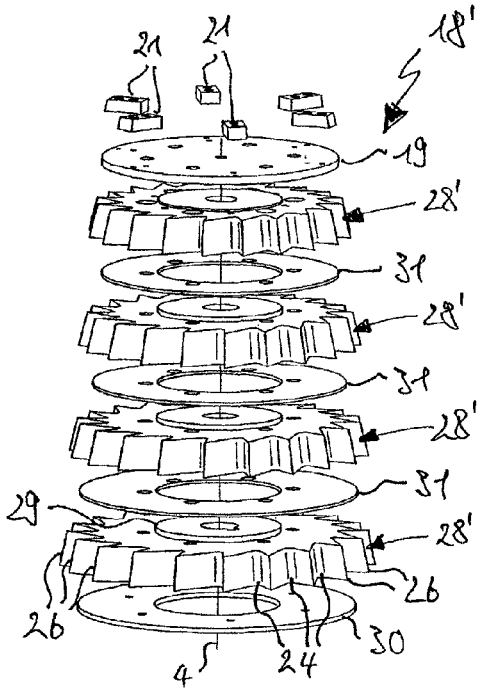

The top side of rotor element 28 is covered by an impact plate 19, disposed coaxially to axis 4, at whose outer circumference radially oriented hammering blocks 21 are screwed on (also see FIGS. 5 and 6). A disc-shaped chamber 22, in which pre-crushing of the feedstock is carried out, is formed by maintaining an axial distance between impact plate 19 and cover 12 or inlet connection 13.

Rotor element 28 is subdivided in the radial direction into an inner area forming a bearing body 40, which is connected rotationally fixed to drive shaft 17, and an outer area, forming rotor tools 23, whereby rotor tools 23 are held by bearing body 40. Stator tools 20 and rotor tools 23 lie opposite with maintenance of a radial working gap 36 (FIGS. 7, 8, and 9), in which the processing of the feedstock occurs primarily. The specific design of rotor tools 23, distributed uniformly over the circumference of rotor 18, and their opposite arrangement will be discussed in greater detail below.

The type of processing depends critically on the surface design of rotor 18. A rotor 18 of the invention opens up many possible surface designs, which cannot be achieved in prior-art rotors or achieved only with the application of disproportionately large structural costs. Some of the few embodiments, which are within the scope of the invention, are described hereinafter without being limited thereto.

FIGS. 3*a* and 3*b* show in each case a monolithic rotor element 28 of a rotor 18, only half of which is shown for the sake of simplicity and whose area, assigned to axis 4 or drive shaft 17, forms a bearing body 40, which as a result of the one-piece design bears rotor tools 23 forming the outer surface of rotor 18. The rotor tools 23 have indentations 24, which are introduced into the outer surface of rotor 18, for example, by milling or electrical discharge machining. Indentations 24 have a longitudinal direction tangential to axis 4 and are disposed in the circumferential direction one behind the other, in several axially successive circumferential planes 25. In this regard, the tangential distances between two indentations 24 each form a web 26, and the area between two adjacent circumferential planes 25 forms a continuous annular web 27. This results in a plurality of circumferential planes 25, which slow down the axial material flow and thus increase the residence time of the feedstock in the processing zone.

The sequence of indentations 24 in the circumferential direction is selected so that webs 26 of two adjacent circumferential planes 25 are disposed with a circumferential offset to one another. This can be achieved by different lengths of indentations 24 (FIG. 3*a*) or with a circumferential offset by half the length of an indentation 24 with otherwise the same lengths of indentations 24 per circumferential plane 25 (FIG. 3*b*).

An arrangement of the indentations in such a way that webs 26 of adjacent circumferential planes 25 are on a surface line of rotor 18 is not shown but is also within the scope of the invention.

FIGS. 4*a* and 4*b* differ from the previously described embodiment of a rotor 18 only in the direction of indentations 24, which in this exemplary embodiment have a longitudinal direction parallel to a surface line. Continuous webs 26 are formed in this way over the entire height of rotor 18. In this regard, indentations 24, as shown in FIG. 4*a*, can be grouped in plane-parallel circumferential planes 25, so that continuous annular webs 27 arise between the circumferential planes 25, or the ends of two indentations 24 adjacent in the circumferential direction are disposed with an axial longitudinal offset, as shown in FIG. 4*b*. These embodiments of the invention lead to cylindrical eddies with a small diameter but high velocity. Because the feedstock flow encounters fewer axially acting flow obstacles than in the previously described embodiment, its residence time in the processing zone is correspondingly shorter.

In contrast to FIGS. 3 and 4, which show a rotor 18 having a single rotor element 28, rotor 18', shown in FIGS. 5 and 6, includes several disc-shaped rotor elements 28', which in each case are formed monolithic and joined coaxially to one another. To make this situation clearer, FIGS. 5 and 6 show the invention as an exploded diagram. The same aforementioned advantages can be achieved with such a rotor 18' with a simultaneously simplified manufacture. In addition, rotor 18' can also be modified subsequently in its geometry and thereby its mode of action by combination of different rotor discs 28'.

In FIG. 5, rotor 18' includes, for example, of four disc-shaped rotor elements 28', which are divided in the radial direction into an inner area forming a bearing body 40 and an outer area forming rotor tools 23. Rotor tools 23 are held by bearing body 40 due to the monolithic design of rotor elements 28'.

Rotor tools 23 are formed by indentations 24, which are distributed uniformly over the circumference of rotor elements 28' and produce the saw-tooth-like rotor tools 23, whose more precise embodiment will be described further under FIG. 10. The disc-shaped rotor elements 28' with their bearing body 40 in each case are mounted on drive shaft 17 in such a way that indentations 24 of adjacent rotor elements 28' are aligned in the axial direction; therefore several indentations 24 produce an overall indentation extending in the axial direction across several circumferential planes 25 along a surface line of rotor 18'. It is also possible to move two adjacent disc-shaped rotor elements 28' in the circumferential direction by half the length of an indentation 24. Lateral boundary surfaces, acting in the axial direction, which keep the feedstock within the area of the rotor tools for a longer time, arise in this way.

Each disc-shaped rotor element 28' has on its top side a cylindrical lug 29 and on its bottom side a recess complementary thereto. Because of the positive fit arising with the axial joining of the disc-shaped rotor elements 28', a centering of rotor elements 28' to one another is achieved. The already mentioned impact plate 19 with hammering blocks 21 in turn forms the top closure of the thus arising rotor 18', and an annular disc 30 forms the bottom closure. The individual parts of rotor 18' are clamped together by means of an axially acting clamp, which is not shown.

Rotor 18' according to FIG. 6 differs from the just described embodiment only in the interconnection of coaxial retarding discs 31 between adjacent disc-shaped rotor elements 28'. The diameter of retarding discs 31 is selected so that retarding discs 31 with their circumference partially or completely overlap indentations 24 radially. Therefore, the residence time of the feedstock in the area of rotor 18' can be influenced by suitable selection of the diameter of retarding discs 31 and thereby the intensity of the processing.

Figure 10:
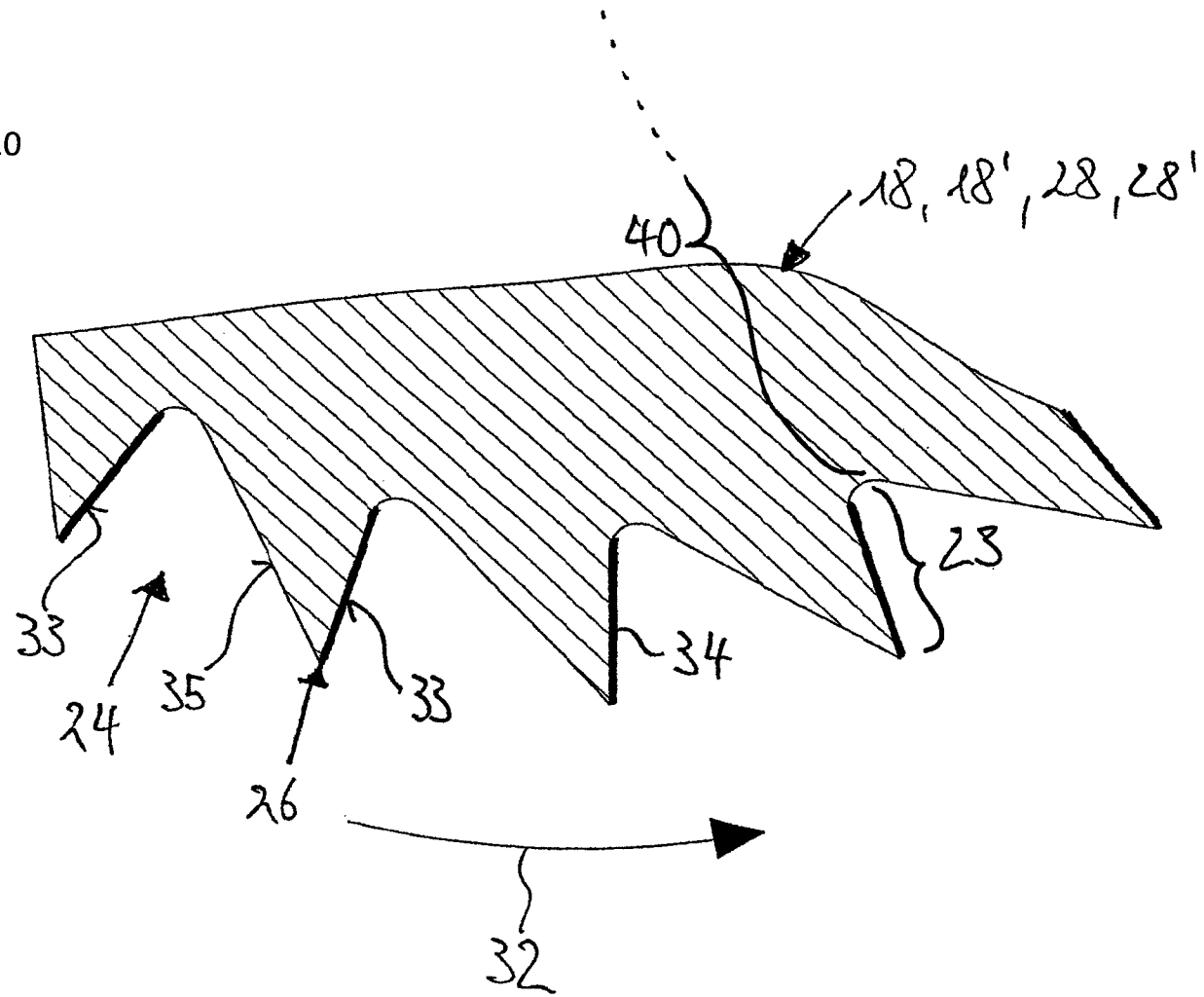
FIG. 10 shows a partial section through a rotor of the invention in its circumferential area.

The profile of indentations 24, selected in conjunction with rotor 18' according to FIGS. 5 and 6, is shown in greater detail in FIG. 10. Indentations 24 in an axial plan view have an asymmetric course, which has the effect that in the circumferential direction 32 webs 26 have a leading edge 33 with an approximately radial direction, whereas the trailing edge 35 in contrast is flatter and at the base of the indentation 24 merges in a curvature into the leading edge 33 of the following web 26. The leading edge 33 can be provided, moreover, with a wear layer 34 to increase the tool lifetime. A saw-tooth-like embodiment of rotor 18' over its circumference arises in this way, which is notable for its aggressive crushing performance.

Figure 7:
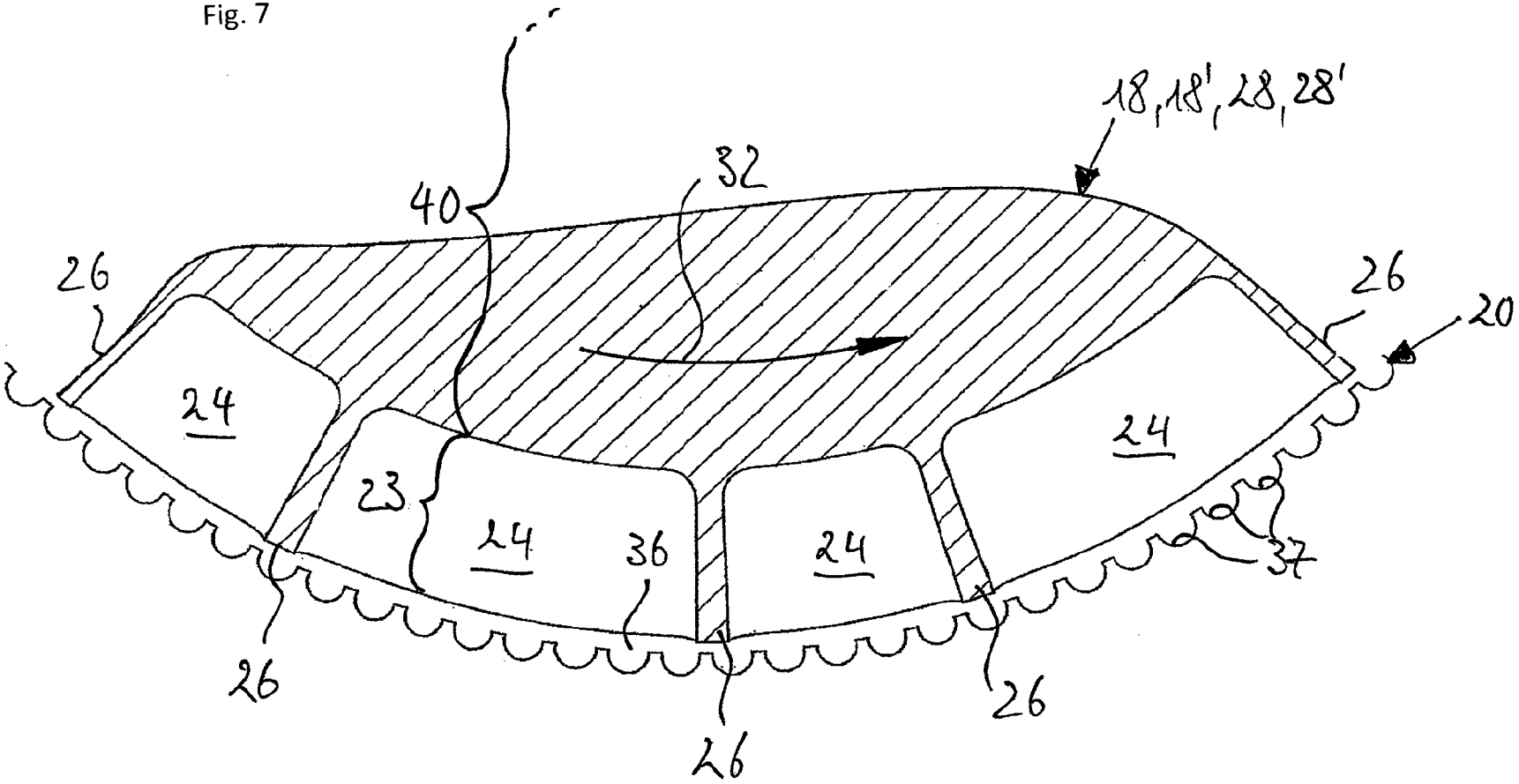
FIGS. 7 to 9 show partial sections of different embodiments of the invention in the area of the working gap.
Figure 8:
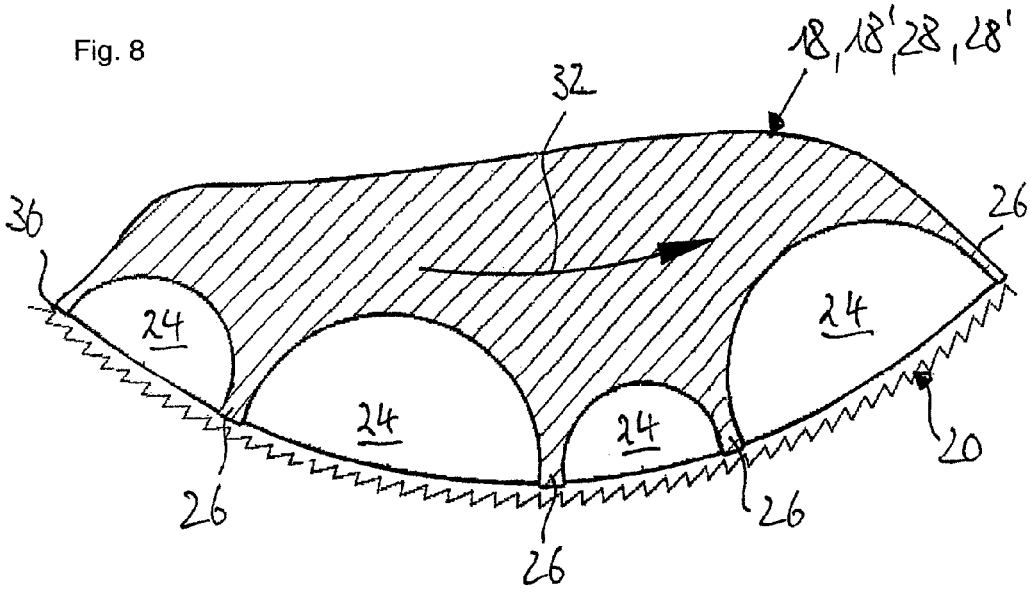

Other possible embodiments of indentations 24 emerge from FIGS. 7 and 8. Thus, it is possible to vary the length and/or also radial depth of indentations 24 following one another in the circumferential direction, to achieve a specific type of processing. In this respect, small indentations lead to eddies with a small diameter but high velocity, whereas large indentations form a relief zone with eddies with a large diameter and low velocities. The changing of these different eddies promotes an intense disintegration of the feedstock.

As shown in FIG. 7, indentations 24 in an axial plan view can be formed essentially rectangular, whereby the corner areas are preferably rounded off, to achieve a constant course approximating the flow. In this regard, indentations 24 here as well are separated by radially extending webs 26 with a symmetric cross section. Evident further in FIG. 7 is the inner surface of stator tools 20, which lie opposite to indentations 24 and webs 26 with maintenance of a working gap 36. The surface of stator tools 20 is formed by a plurality of semicircular recesses 37, which extend in the axial direction over the entire height of rotor 18.

FIG. 8 shows another embodiment of a rotor 18 of the invention. Indentations 24 depicted there have a semicircular form in an axial plan view, whereby successive indentations 24 in the circumferential direction have a different radius. As a result, successive indentations 24 have both a different length and a different depth. The semicircular shape of indentations 24 corresponds at least in part to the eddy path, so that the self-cleaning effect occurring as a result prevents deposits in the indentations. In FIG. 8, indentations 24 and webs 26 arising between indentations 24 act together with the saw-tooth-like stator tools 20.

Figure 9:
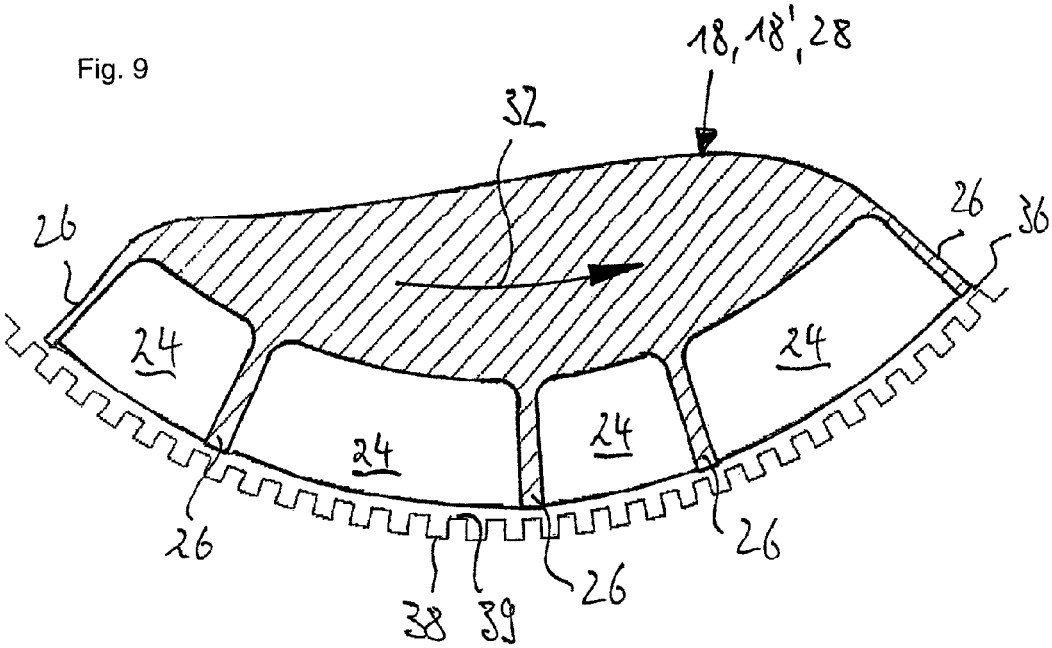

Another embodiment of stator tools 20 is shown in FIG. 9, which discloses a meandering course of the surface of stator tools 20 with grooves 38 and ridges 39 running axially and having a square cross section. The rotor 18, 18' shown in FIG. 9 corresponds otherwise to the rotor depicted and described in FIG. 7. It emerges from FIGS. 7 through 9, moreover, that the extension of indentations 24 of rotor 18, 18' in the circumferential direction corresponds to a multiple, for example, at least to 4-fold, of the comparable extension of recesses 37.

It is understood that the invention is not limited to the feature combinations disclosed here in the individual exemplary embodiments, but, of course, embodiments are also covered in which the features of different embodiments are combined with one another. For example, indentations 24 shown in FIGS. 7 to 10 can be realized both on a rotor 18 with only one rotor element 28 and on a rotor 18' with a disc-shaped structure. All geometric configurations of webs 26 and/or indentations 24 of a rotor 18, 18' vary in their length and depth or different geometric forms of webs 26 and/or indentations 24 can be combined in the circumferential direction or from circumferential plane 25 to circumferential plane 25.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for mixing, grinding, drying, deagglomeration, crushing, or coating of feedstock, the device comprising:

a housing;

a rotor mounted on a drive shaft that is configured to rotate around an axis within the housing, the rotor having at least one disc-shaped rotor elements arranged coaxially with respect to each other and a rotation axis, the rotor elements being subdivided in a radial direction into an inner area thereby forming a bearing body that is connected rotationally fixed to the drive shaft;

a stator configured to be fixed relative to the housing, the stator encompassing the rotor such that a radial working gap is formed; and rotor tools that form an outer area, the rotor tools being held by the bearing body and act together with the stator tools on an inner circumference of the stator, wherein the feedstock is supplied in a carrier gas stream to the radial working gap, wherein, to form the rotor tools, a plurality of indentations are disposed on the outer circumference of the rotor elements of the rotor, the individual outer circumferences of the rotor elements together forming a shell of the rotor, wherein areas between two adjacent indentations form webs, which form active edges of the rotor tools for processing of the feedstock, wherein the inner area of each rotor element forming the bearing body and the outer area of each rotor element formed from the rotor tools are formed monolithic as different areas of a single workpiece, wherein the rotor has at least one annular web, lying on a circumferential ring, as a retarding element, and wherein the annular web is formed in each case by a retarding disc disposed coaxially between the rotor elements.

2. The device according to claim 1, wherein a main extension direction of the indentations runs in a circumferential direction of the rotor.

3. The device according to claim 1, wherein a main extension direction of the indentations runs perpendicular to the circumferential direction, thereby parallel to a surface line of the rotor.

4. The device according to claim 1, wherein the indentations in several axially staggered levels are disposed next to one another and the individual indentations of a plane are disposed one behind the other aligned in the circumferential direction.

5. The device according to claim 1, wherein adjacent indentations are disposed with an offset to one another in the circumferential direction and/or in an axial direction.

6. The device according to claim 1, wherein adjacent indentations have different lengths and/or depths.

7. The device according to claim 1, wherein a ratio of a length to depth of the indentations is within a range of 2:1 to 3:1.

8. The device according to claim 1, wherein the webs are formed symmetric in cross section.

9. The device according to claim 1, wherein the webs are formed asymmetric in cross section, and wherein a leading edge of the web in the rotation direction of the rotor is steeper than a following edge.

10. The device according to claim 1, wherein sides of the indentations, forming the outer circumference of the rotor element, merge continuously into one another.

11. The device according to claim 1, wherein the leading edge of the web in the rotation direction is formed wear-resistant at least in subareas.

12. The device according to claim 1, wherein the disc-shaped rotor elements have indentations along their outer circumference, which together with the indentations of adjacent rotor elements form a continuous overall indentation.

13. The device according to claim 1, wherein the annular web is formed by the webs limiting the indentations in the axial direction.

14. The device according to claim 1, wherein the rotor has substantially a cylindrical or truncated-cone shape.

15. The device according to claim 1, wherein the rotor has channels for conveying a cooling medium.

16. The device according to claim 1, wherein the rotor has a cylindrical or conical outer surface.

17. A device for mixing, grinding, drying, deagglomeration, crushing, or coating of feedstock, the device comprising:

a housing;

a rotor mounted on a drive shaft that is configured to rotate around an axis within the housing, the rotor having at least one rotor element that is subdivided in a radial direction into an inner area thereby forming a bearing body that is connected rotationally fixed to the drive shaft;

a stator configured to be fixed relative to the housing, the stator encompassing the rotor such that a radial working gap is formed; and rotor tools that form an outer area, the rotor tools being held by the bearing body and act together with the stator tools on an inner circumference of the stator, wherein the feedstock is supplied in a carrier gas stream to the radial working gap, wherein, to form the rotor tools, a plurality of indentations are disposed on the outer circumference of the at least one rotor elements of the rotor, wherein areas between two adjacent indentations form webs, which form active edges of the rotor tools for processing of the feedstock, wherein the rotor has at least one annular web, lying on a circumferential ring, as a retarding element, and wherein the annular web is formed in each case by a retarding disc disposed coaxially between the rotor elements.

18. An apparatus for processing feedstock, comprising:

a housing;

a rotor mounted on a drive shaft that is configured to rotate around an axis within the housing, the rotor having at least two disc-shaped rotor elements arranged coaxially with respect to each other and separated by a retarding disc disposed coaxially between the rotor elements, each rotor element being subdivided in a radial direction into an inner area forming a bearing body that is rotationally fixed to the drive shaft and an outer area forming rotor tools held by the bearing body, wherein the rotor tools are formed from a plurality of indentations disposed on an outer circumference of each rotor element and a corresponding plurality of webs formed by areas between adjacent indentations; and a stator configured to be fixed relative to the housing, the stator encompassing the rotor such that a radial working gap is formed for processing the feedstock in conjunction with the rotor tools on an inner circumference of the stator.

* * * * *

UNITED STATES PATENT AND TRADEMARK OFFICE

CERTIFICATE OF CORRECTION

PATENT NO. : 8,480,016 B2
APPLICATION NO. : 12/777798
DATED : July 9, 2013
INVENTOR(S) : Pallmann It is certified that error appears in the above-identified patent and that said Letters Patent is hereby corrected as shown below:

Title Page, Item (73) Assignee Change:

Mascinenfabrik GmbH & Co. KG, Zweibruecken, (DE)

To:

Maschinenfabrik GmbH & Co. KG, Zweibruecken, (DE)

Signed and Sealed this
Twentieth Day of August, 2013

Teresa Stanek Rea
*Acting Director of the United States Patent and Trademark Office*